United States Patent [19]

Wilson

[11] 4,393,971

[45] Jul. 19, 1983

[54] COIN-CONTROLLED VENDING APPARATUS

[76] Inventor: James H. Wilson, 804 W. Mitchell, #410, Arlington, Tex. 76013

[21] Appl. No.: 200,762

[22] Filed: Oct. 27, 1980

[51] Int. Cl.[3] ..... G07F 11/44; G07F 13/02

[52] U.S. Cl. ..... 194/93; 221/24; 221/265; 222/1

[58] Field of Search ..... 194/93, DIG. 11, 2; 221/24, 265; 222/78, 1; 46/42

[56] References Cited

U.S. PATENT DOCUMENTS

| | | | |
|---|---|---|---|
| 616,495 | 12/1898 | Rouillion | 194/27 |
| 680,893 | 8/1901 | Stelzer | 46/42 |
| 1,725,965 | 8/1929 | Ormiston | 221/24 |
| 1,758,061 | 5/1930 | Rentz et al. | 46/42 |
| 2,003,801 | 6/1935 | Boyer | 194/93 X |
| 2,785,504 | 3/1957 | Kooistra | 46/42 |

*Primary Examiner*—F. J. Bartuska
*Attorney, Agent, or Firm*—Charles W. McHugh

[57] ABSTRACT

A vending apparatus for dispensing a controlled amount of material upon deposit of a prescribed coin. A high reservoir contains material such as candy or the like in suitable holders such as size-V plastic capsules. A coin-operated device, preferably including a coin slide mechanism, is manually operated by a customer. When the slide is pushed in and pulled out by the customer, he contributes energy to the apparatus which is utilized in dispensing the material in an amusing way. In one embodiment, the act of moving the coin slide causes a relatively heavy steel ball to be elevated to a position where it engages a transportation device such as a simulated coal car or bulldozer. The transportation device carries the plastic capsule from a loading station (immediately below the reservoir) to an unloading station some distance away—where the capsule is dumped into a dispensing chute to be received by the customer. The steel ball is disengaged from the transportation device at the unloading station, and a counter-weight causes the transportation device to return to its loading station where it rests until a new coin is deposited, etc. Because the transportation device is designed to respond to the presence of the heavy steel ball instead of the presence of the vended material, the apparatus is relatively immune to any variation in weight between capsules.

18 Claims, 12 Drawing Figures

COIN-CONTROLLED VENDING APPARATUS

This invention relates generally to a vending apparatus which dispenses something in response to the insertion of a prescribed coin. More particularly, it relates to a vending apparatus having a mechanism within the field of view of the customer which is actively involved in transporting the purchased matter from a reservoir to a dispensing chute.

It is well known to combine a vending apparatus with some sort of device which provides entertainment for a customer as a part of the vending process. For example, U.S. Pat. No. 616,495 to Rouillion (circa 1898) discloses a first mechanical figure representing a football player who carries an article to a position where it may be "kicked" by a second football player into a delivery chute. Another dispensing device is shown in U.S. Pat. No. 1,725,965 to Ormiston, which is particularly adapted for dispensing candy-coated chewing gum balls or other globular articles. While both of these devices probably offered substantial sales appeal to both the purchasers and bystanders, one reason they have not been widely utilized in recent years may be the complexity of their mechanisms, the number of parts required and the adjustments needed to make them operate, and their sensitivity to relatively simple things like proper lubrication. Another difficulty with many prior art dispensing devices is that they have been designed and are uniquely suited for a single type of merchandise—such as peanuts, chewing gum, or plastic capsules. That is, an apparatus built in accordance with the Rouillion design for kicking a piece of gum over a simulated goal post could not be used to dispense a quantity of loose peanuts. Similarly, an apparatus in accordance with the Ormiston design can be used to dispense a gum ball or a plastic capsules—but it could not be used to dispense something that is not reasonably globular in shape, such as small mints or a handful of similarly shaped candies. Accordingly, there has remained a need for a truly versatile dispensing apparatus which offers the entertainment value of some previously known devices but which achieves its results through a much simpler and more reliable mechanism. It is an object of this invention to provide such an apparatus.

Another object is to provide a dispensing apparatus which does not require an external energy source to achieve operation of the dispensing mechanism, and which relies solely on the energy expended by the customer during the process of inserting a coin as he acts to obtain the desired merchandise.

A further object is to provide a dispensing apparatus which is capable of handling a wide variety of merchandise, including relatively large capsules, gum balls, candy balls—as well as relatively small items such as peanuts and mints, etc.

Still another object is to provide a dispensing apparatus which is relatively immune to variations in the weight of merchandise which is to be dispensed, such that articles varying in weight by a factor as great as 10 may be dispensed with equal reliability and without requiring any adjustment in the dispensing apparatus when the dispensed merchandise is changed.

These and other objects will be apparent from a reading of the specification and the claims appended thereto, as well as reference to the attached drawings in which FIG. 1 is a front elevational view of an exemplary apparatus in which a movable element in the form of a miniature "coal car" is adapted to receive material to be vended;

In brief, the invention includes a vending apparatus having a coin-operated device which requires the operator to manually push a coin slide for a certain distance or rotate a wheel through a certain arc, etc. The internal dispensing apparatus is connected through appropriate linkage to the coin-receiving device in such a way that energy expended by a customer in inserting a coin is utilized to "drive" the dispensing apparatus. In order to amuse a customer and provide at least some visible action in the dispensing process, a movable element is provided which makes an excursion from a loading station to an unloading station. The movable element may be a simulated "coal car" or bulldozer or the like. In order to make the dispensing apparatus essentially "blind" to the weight of the merchandise that is to be dispensed, a relatively heavy ball serves to move certain parts of the apparatus (including the merchandise receptacle) as the ball goes from one elevation to a lower elevation during the dispensing process. An exemplary weight for such a ball is about 35 grams—which is significantly more than the weight of most any merchandise that is presently vended through machines of this type. Changing the nature of the merchandise to be dispersed and thereby changing the weight of the dispensed merchandise is of negligible consequence and therefore no adjustment in the apparatus is necessary—because of the relatively heavy ball which serves as the driving force for the receptacle.

Figure 1:
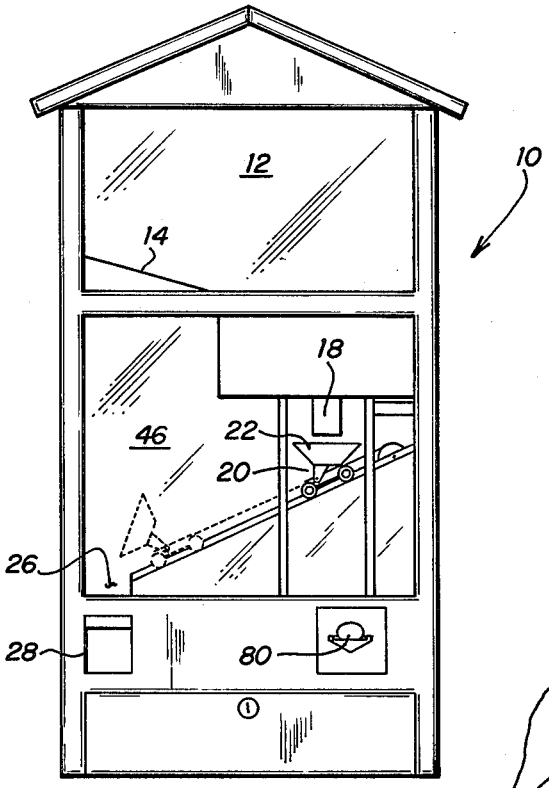

Referring initially to FIG. 1, an apparatus 10 for vending certain material upon deposit of a prescribed coin is shown in a frontal, elevational view. At the top of the apparatus is a reservoir 12 for holding a quantity of material which is to be subsequently dispensed in controlled quantities. In this example, it will be assumed that the material is contained in a clear plastic capsule (such as a well-known V capsule) behind a glass plate, so that the customer may see that the reservoir has material to be vended. The bottom of the reservoir 12 will typically be a slanted floor 14 of sheet metal or the like; the floor is inclined in order to cause capsules to move progressively downward (by gravity) to a location where they may be deposited on a device for feeding capsules, one at a time, to a loading chute 18. Also shown in FIG. 1 is a simulated coal car 20 which has a loading position that is immediately below the loading chute 18. The coal car 20 has a receptacle in the form of an open-top hopper 22 whose opening is slightly greater than the discharge area of the chute 18, in order that there will not be a likelihood of any material—such as loose peanuts—falling out of the chute and not hitting the hopper. The hopper 22 is pivotable about a horizontal axis at the front of the coal car 20, but the hopper is quite stable when it is in its loading position and it does not tilt until it reaches its unloading station.

Also apparent in FIG. 1 is a inclined track 24 which serves to restrict the travel of the coal car 20 from its loadng station to its unloading station (and vice versa). Immediately below the unloading station is a dispensing chute 26 which receives the material to be vended and directs it to a spout 28 where the material can be grasped by a customer. On the lower right side of the housing is a coin-operated slide which is manipulatable by a customer in a well-known manner. The preferred embodiment of such a coin-operated slide is a mechanism similar to that shown in U.S. Pat. No. 3,371,763 and manufactured by Monarch Product Sales Corp. of Macon, Ga.; in such a mechanism, a horizontal recess is provided for receiving a given coin and holding it until such time as the customer pushes the slide inward to deposit the coin within the housing and activate the vending mechanism.

Figure 2:
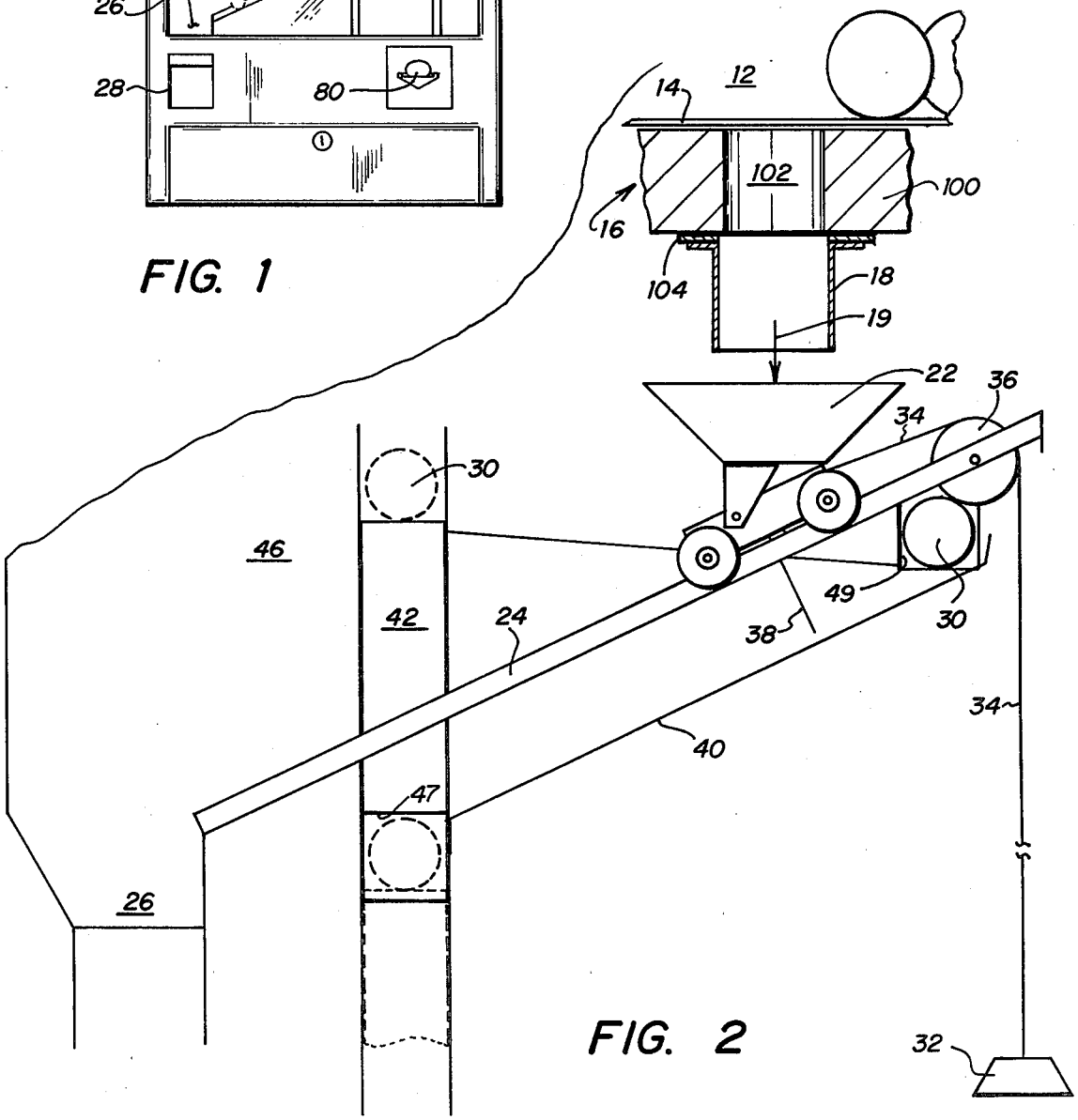
FIG. 2 is a schematic illustration of the mechanism which causes the apparatus of FIG. 1 to operate, with the "coal car" being shown in its elevated position where it receives material to be vended.

Referring next to FIG. 2, the general principle of operation should be more readily apparent—with the housing and cosmetic covers removed. The reservoir 12 is shown with a quantity of generally bole-shaped capsules resting on the inclined floor 14. Feeding means 16 responds to the deposit of a prescribed coin by rotating (in a manner that will be more fully described hereinafter) so as to pass individual ones of the capsules to the loading station for the coal car 20. There arrow 19 represents the direction of movement of an individual capsule as it falls downward into the receptacle or hopper 22 on the coal car. Deposit of the capsule into the hopper 22 is, of course, a necessary step in vending the merchandise; but, in accordance with this invention, adding the weight of the merchandise to the weight of the hopper is not what causes the hopper to move. Rather, the mechanism described herein operates by moving a relatively heavy weight, preferably in the shape of a ball 30, to a position where it interacts with the coal car and causes it to move downward. The ball 30 is preferably made of steel and is about 2 cms in diameter, weighing about 37 grams; a typical coal car formed from thin sheet metal will probably weigh about 22 grams, and a V plastic capsule will weigh about 2 grams. Exemplary merchandise to be vended for, say, 25¢ might be: a giant gum ball, 10 grams; a "Big Blip" piece of hard candy, 15 grams; a dozen Wallace "Gourme" mints, 21 grams; a dozen "French burnt" peanuts, 15 grams; and a small plastic trinket, about 1 gram. Thus, the light weight of a V capsule with a small plastic trinket (about 3 grams) can differ in weight from a dozen mints by a factor of about 7. And, if the operating mechanism was dependent upon the weight of vended merchandise to initiate descent of the coal car, there would have to be repeated adjustments of the mechanism every time that a merchant elected to change his merchandise—if it involved a significant change in vended weight. But, by using a relatively heavy steel ball to supplement the weight of the merchandise, there will always be sufficient weight to drive the coal car downward to its unloading station.

At the time that the coal car 20 reaches the lower end of its excursion path, the ball 30 is caused to escape from the restraining channel that had held the ball so that it pushed against a depending tongue 38 attached to the coal car 20. The ball typically escapes rearwardly to a location where it rests until another customer arrives. When the ball is no longer pressing against the depending tongue 38, a counterweight 32 (connected through cable 34 and pulley 36 to the coal car 20) is sufficiently heavy as to cause the empty coal car to be pulled upward along the linear excursion path so that it is once again present at the loading station. The inclined track 24 makes an angle of about 25 degrees with the horizontal, so a counterweight of only about 15 grams is adequate to pull the empty coal car 20 at a reasonable speed back to its loading station. If a faster return should seem to be desirable, a larger counterweight could be used. Also, if cycling speed should ever be of interest to the owner of the apparatus 10, a second ball 30 can be captured within the travel loop that includes an elevator; with a second ball in the system, the two balls naturally alternate in pushing the coal car 20 down to its dumping location.

Figure 3:
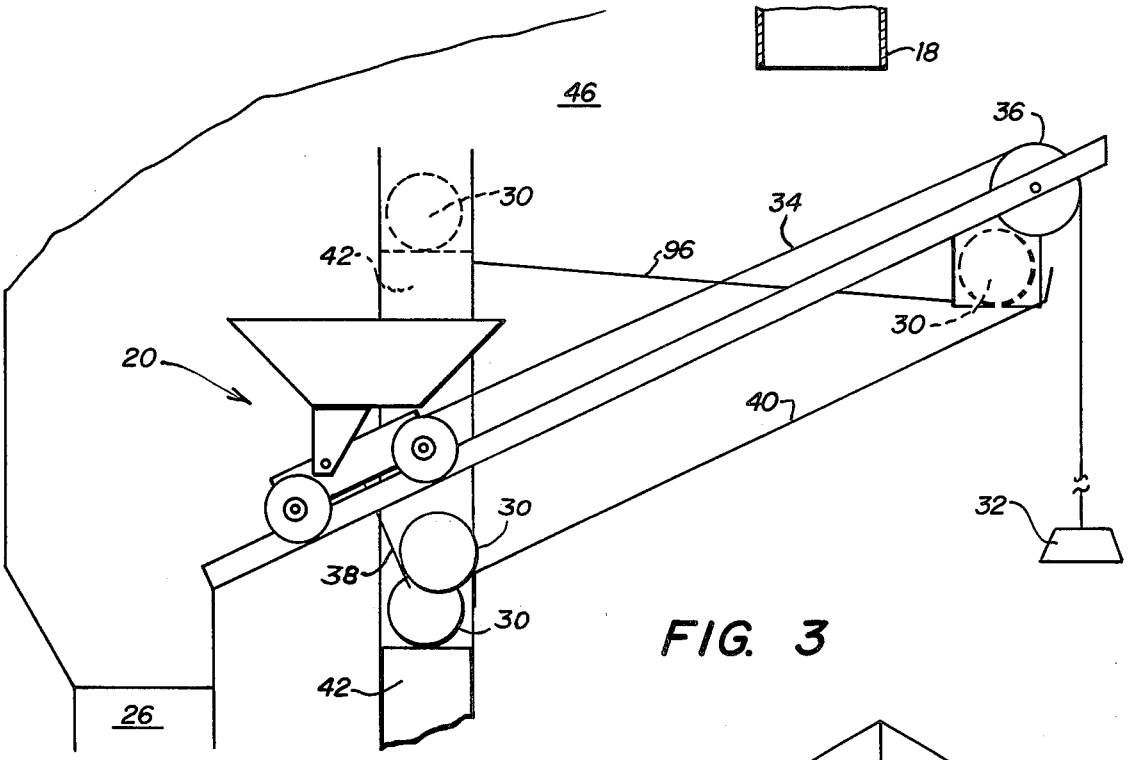
FIG. 3 is a schematic view similar to FIG. 2, wherein the "coal car" has been translated to its "dumping" position—at which the material is dropped into a chute for delivery to the customer.

In the schematic illustration of FIGS. 2 and 3, a released ball 30 is allowed to roll downward along track 40 and then make a slight turn to a position where it comes to rest alongside an elevator block 42. At the time that a customer pushes in the slide of the coin mechanism, this elevator block 42 moves downward to receive the ball (using lever arms and cables which are not shown in these figures); pulling the slide outward causes the elevator block 42 to rise until the ball is free to roll off the top of the elevator block and engage the depending tongue 38. Thus, the ball 30 makes a loop from: (1) its rest position beside the elevator (prior to deposit of the critical coin), (2) to a higher position when the elevator is raised, (3) to a tongue-engaging position adjacent the coal car, (4) downward to a car-releasing position and (5) backward to the original rest position. The only powered part of this loop is the upward movement on the elevator, during which the customer imparts potential energy to the ball as an integral part of inserting the necessary coin. Thereafter, the apparatus is non-powered, relying only on the recovery of potential energy in the ball—energy which is furnished by the customer. Thus, there is no necessity for any batteries or other electrically powered devices, nor is there any requirement for a manually tightened spring. Perhaps it should be mentioned here, however, that the position at which the ball comes to rest at the end of a duty cycle is to a great extent a matter of preference on the part of the designer. And, the schematic representation shown in FIGS. 2 and 3 is not intended to be limiting—to the exclusion of other suitable arrangements for causing the ball to temporarily act on the movable car 20. Also, it should be understood that the relative position of the elevator and the track with respect to the loading station can be changed in order to fit a particular spatial envelope within a given housing. But, regardless of where or how the ball engages the movable element 20, it is believed to be advantageous to conceal that engagement from the eyes of the customer—in order to add perhaps some mystique to the operation of the apparatus.

Figure 4:
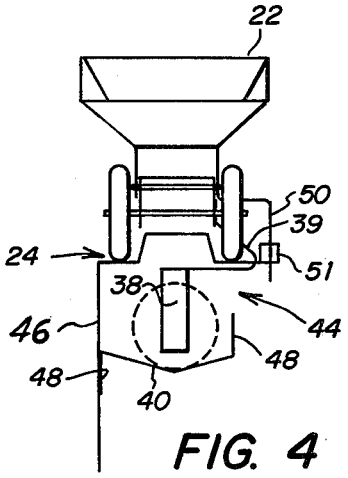
FIG. 4 is a fragmentary end view of the inclined track on which a "coal car" moves as it travels between its loading and unloading stations.

One manner in which the ball 30 may be effectively concealed is shown in FIG. 4, which is a somewhat schematic and fragmentary view of the coal car 20 in position adjacent the inclined track 24. Rigidly attached to the coal car and depending therefrom is tongue 38 which is generally planar and which lies in a plane that is approximately perpendicular to track 40. The connection between the main body of the car and tongue 38 constitutes a piece of bent sheet metal 39 which passes through an elongated opening or slot 44 below the track 24. Of course, the tongue 38 and the metal bracket 39 are effectively concealed behind vertical wall 46 which supports track 24 and hides a significant portion of the operating mechanism. The hat-shaped track 24 is easily formed as an integral part of wall section 46; and, like most of the other portions of this apparatus the track 24 can be economically formed with tools that are commonly found in most any sheet metal shop. The sheet metal trough 48 for holding the ball (shown in broken lines in this figure) can be easily attached to wall 46 by spot welding or the like. Of course, that portion of the ball trough 48 which is shown in FIG. 4 is an intermediate or middle portion (i.e., a portion between its two ends) which captures and completely supports the ball. The top end of the trough 48 has a cut-away segment which serves as an entrance for the ball—when the ball leaves the elevator. Similarly, the bottom end of the trough 48 has a cut-away segment to permit the ball 30 to roll off of the trough and onto a track that directs the ball back to the elevator. Also shown in this figure is a depending dump lever 50 which engages a stop 51 at the bottom of inclined track 24 and insures that the hopper 22 tilts forward to "dump" the merchandise at the bottom of its excursion; another stop 53 resets the hopper as it moves back to the loading station.

The embodiment described thus far has clearly described a delivery element in the form of a simulated coal car that travels down a simulated rail track to "dump" its load—for the amusement of the customer and any bystanders. However, it should be clearly understood that the concept disclosed herein is not limited to downward travel of a coal car or other element. In fact, the combination of a manually operated coin slide, an elevator, and a ball which is moved by the elevator upon insertion of a prescribed coin, can be utilized on a path that extends upwardly, downwardly or horizontally from a loading station to an unloading station.

Figure 5:
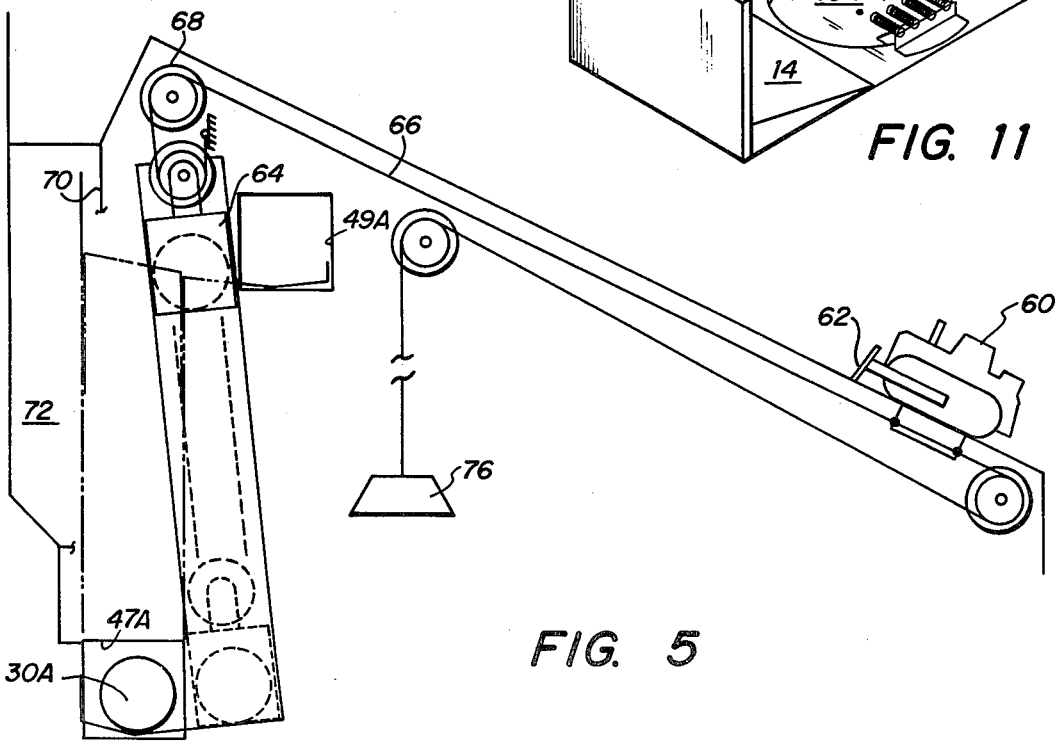
FIG. 5 is a schematic elevational view of an embodiment of the invention in which a "bulldozer" moves upwardly from a loading station to a "cliff" where it unloads the purchased merchandise.

To illustrate possible variations of the general principle disclosed herein, a schematic showing of another vending apparatus is shown in FIG. 5; in this figure, a movable element in the form of a motorized bulldozer 60 is provided to receive matter (which is to be eventually dispensed) in front of the bulldozer blade 62. Like the previously illustrated coal car, the bulldozer 60 is responsive to the suitable placement of a heavy ball in order to move the bulldozer along a prescribed path to an unloading station. In this embodiment, the weighted ball 30A will rest at the bottom of an elevator shaft until a customer inserts a coin and lifts the elevator as an integral part of pulling the coin slide mechanism back to its "start" position. When the ball 30A is lifted to the top of the elevator shaft, it rolls off the elevator 42A and comes to rest on a cup 64 which is connected by cable 66 to the bulldozer 60. The weight of the ball 30A is significantly more than the weight of the bulldozer 60, so the bulldozer is pulled by the descending cup as the cable progressively passes over pulley 68. The bulldozer continues to move upward as the cup moves downward until the material in front of the bulldozer blade is pushed over the "cliff" formed by vertical wall 70 adjacent vending chute 72. Shortly thereafter, the descending cup 64 reaches a relatively low elevation at which it becomes juxtaposed with an opening in a side wall, and the ball 30A rolls out of the open-sided cup and through the opening. The empty cup 64 will then be pulled upward by the significantly greater weight of the bulldozer 60 as it slides back down the inclined ramp to a loading position—where it waits until another coin causes new matter to be dropped from the hopper, etc.

Figure 6:
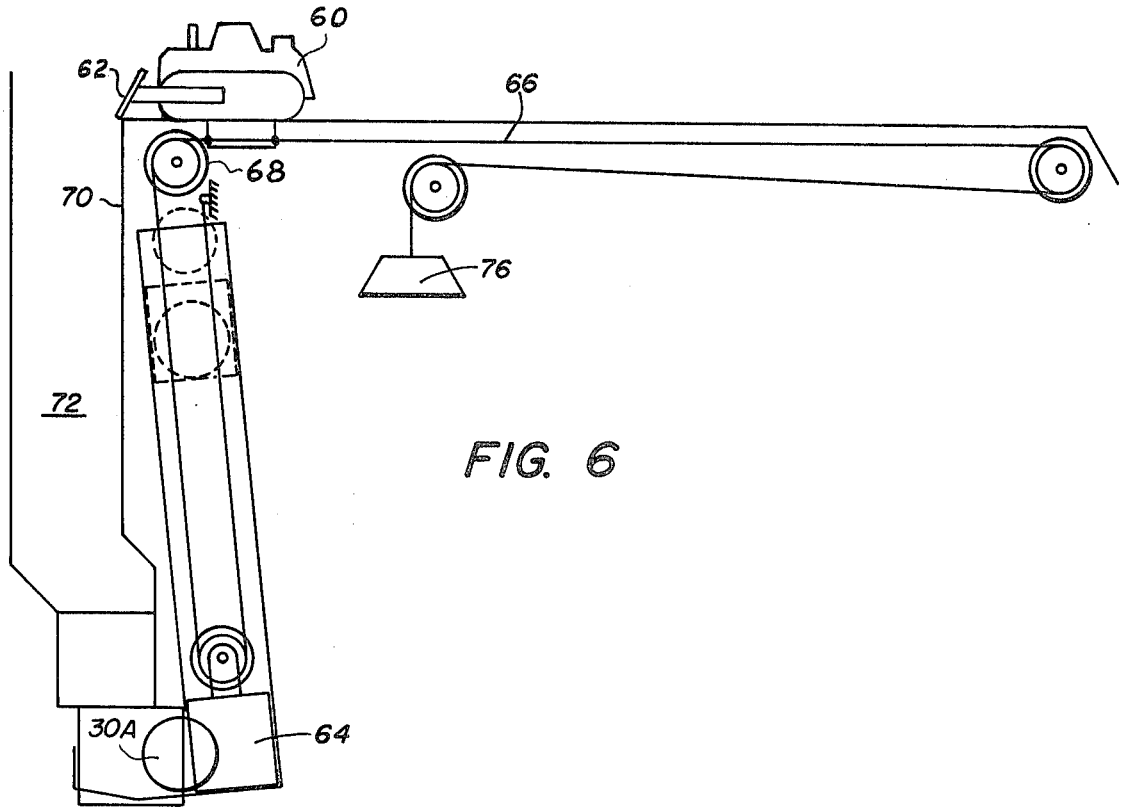
FIG. 6 is a frontal schematic view similar to FIG. 5 wherein the "bulldozer" travels horizontally from a loading station to an unloading station.

In another embodiment, shown schematically in FIG. 6, the movable element is also in the form of a bulldozer and the receptacle for receiving material to be vended is also a simulated bulldozer blade. In this embodiment, the bulldozer travels horizontally from a loading station to an unloading station in response to the combined weight of a ball and a cup which is sized to temporarily support the ball. After the vended material has been pushed over a "cliff" where it can fall into the hands of a waiting customer, the bulldozer is pulled backward to its loading station by a counterweight 76. As before, the ball is moved from a first, low position to a second, high position by an elevator which responds to manual activation of a coin-operated device.

Figure 7:
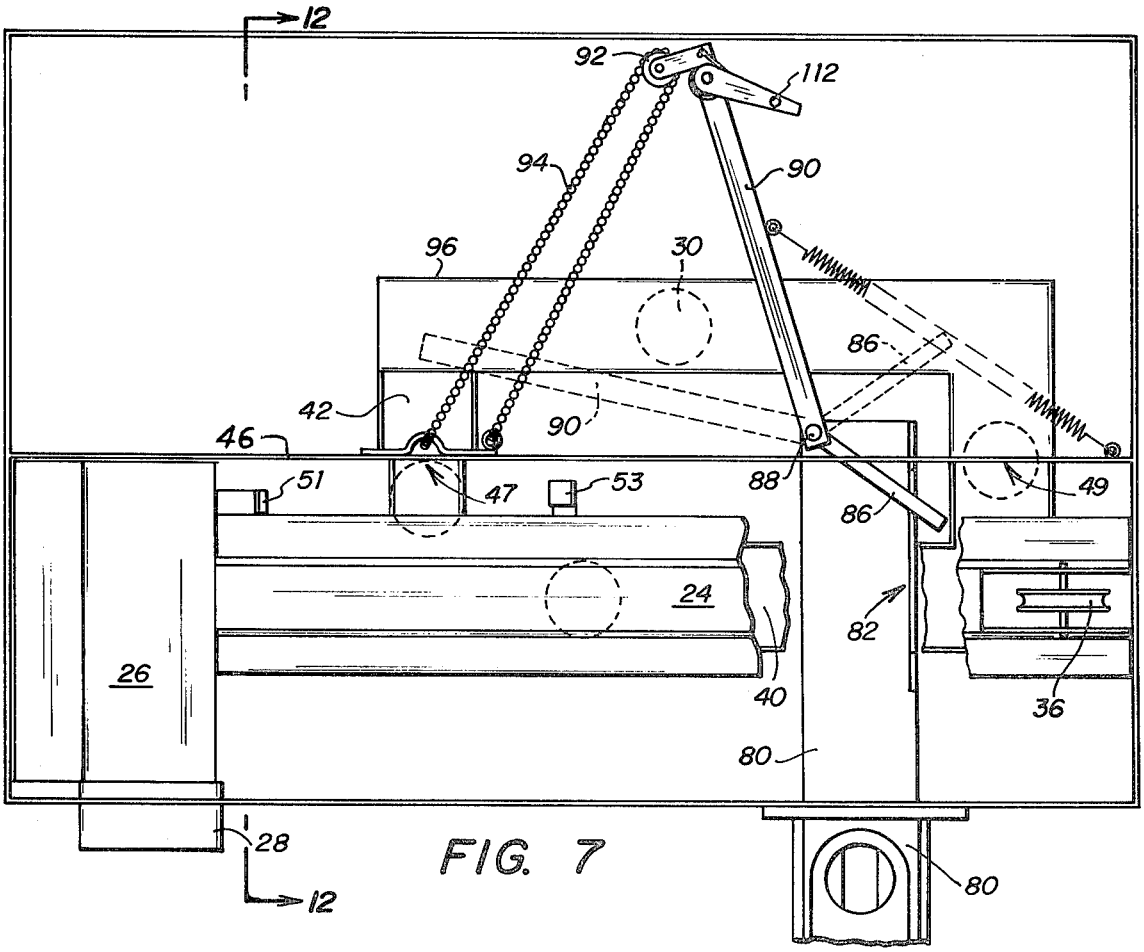
FIG. 7 is a fragmentary, top plan view of the apparatus, with a substantial portion of the cosmetic features being removed in order to better illustrate the mechanical features.

Referring next to FIG. 7, which is a fragmentary top view of the mechanism shown in FIG. 1, a central wall 46 is shown, while the decorative matter in front of the wall, as well as the coal car 20, the track 24, etc., have been omitted for the sake of clarity. The slide 80 of the coin-receiving device is shown in what may be called its "rest" position, where it is ready to receive a new coin from a customer. Attached to the slide 80 is a structural element 82 having a horizontal gap 84 between two upright members. As the slide 80 moves forward in response to manual force exerted by the customer, the rear edge of gap 84 engages the horizontally extending foot 86 of crank 88; continued pushing of the slide 80 will rotate the crank 88 through about 70°. At the top of crank 88 and rigidly connected thereto is lever arm 90. At the distal end of lever arm 90 is a pulley 92, and around this pulley extends a ball chain 94 which is connected to the top of the elevator block 42. When crank 88 rotates approximately 70°, the distal end of lever arm 90 will have moved through an arc of about 4 inches, and the elevator 42 will have dropped the necessary distance to receive the ball 30. By pulling the slide 80 outward, the forward edge of element 82 (adjacent gap 84) makes contact with foot 86 and rotates crank 88 clockwise—back to its starting position. The ball chain 94, of course, is pulled to the right along with lever arm 90, thereby causing the elevator block 42 to be lifted wihin its channel. When the elevator 42 reaches the top of its shaft, the ball 30 is no longer restrained by the closely fitted sides of the shaft, and it is free to roll off the inclined top of the elevator block 42. A suitable channel 96 of sheet metal or the like then guides the ball to the right until it rolls downward to the point where it makes contact with the tongue 38 below the coal car 20. As explained before, the weight of the ball will then cause the wheel-supported coal car to descend to its unloading position, and the ball will then roll off its track 40 to a rest position in anticipation of again entering the elevator shaft for another cycle.

Figure 8:
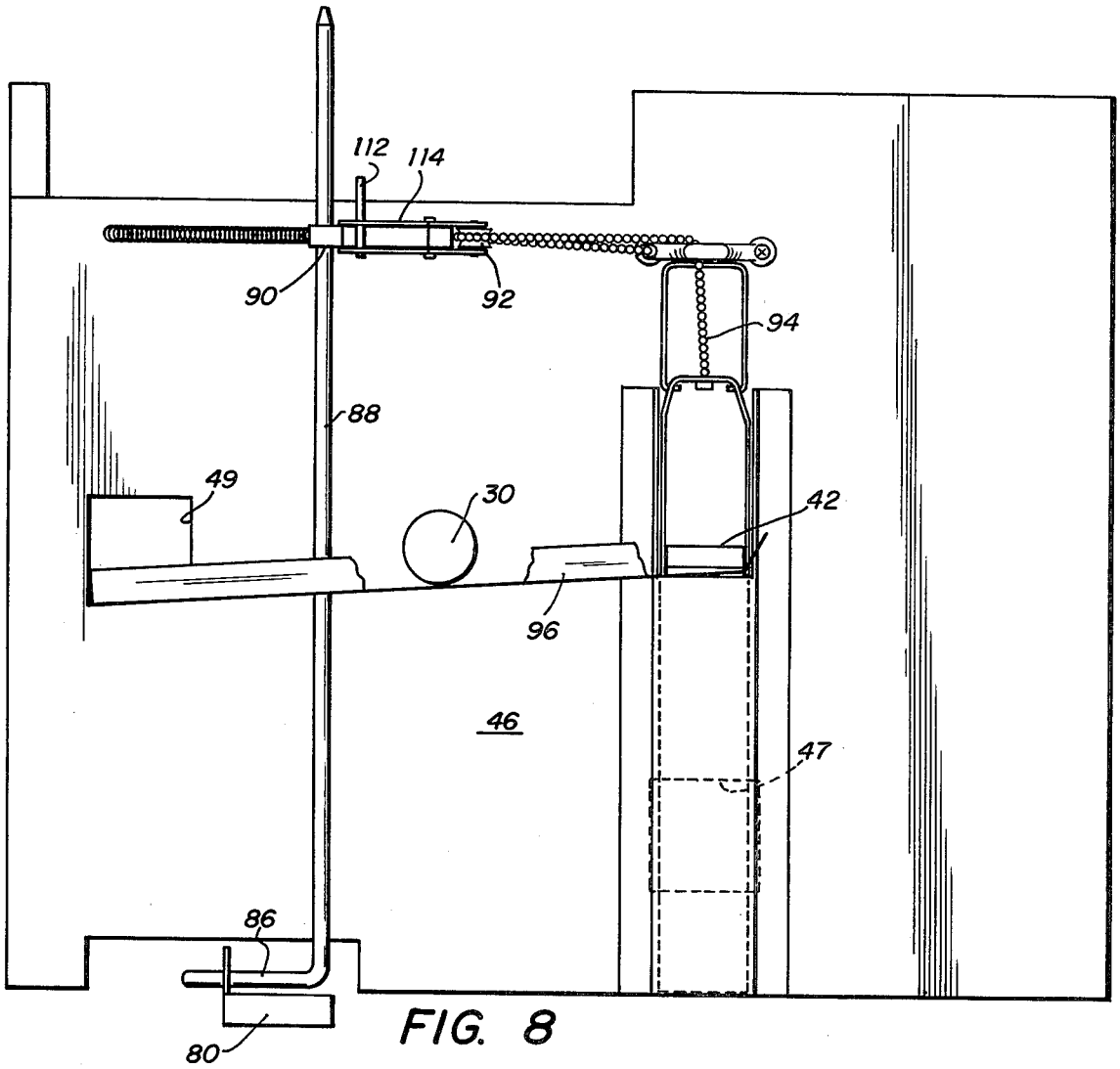
FIG. 8 is a rear elevational view of the operative portions of the apparatus, with the merchandise reservoir and feeding device being omitted for the purpose of enhancing the clarity of this view.
Figure 10:
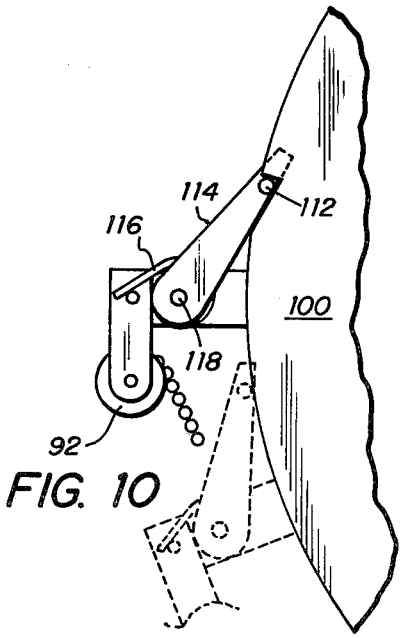
FIG. 10 is a fragmentary, schematic view of the position of a driving pin when it is in a position to drive a dispensing wheel forward, with the non-driving position of the pin being represented by broken lines.

Perhaps it would be appropriate to mention here that the working ball preferably has a rest position which is low—relative to the elevated position where it makes contact with the merchandise-dispensing element. By making the rest position low, there is no need for an auxiliary gate to restrain an elevated ball 30 in a passive mode. This advantage would be lost, of course, if the system was designed so that the ball normally rested at an upper portion where it was ready to act on a coal car just as soon as it was released. The favored "low" rest position for a ball 30 is immediately adjacent the lower opening 47 in wall 46, shown in FIG. 8.

Figure 11:
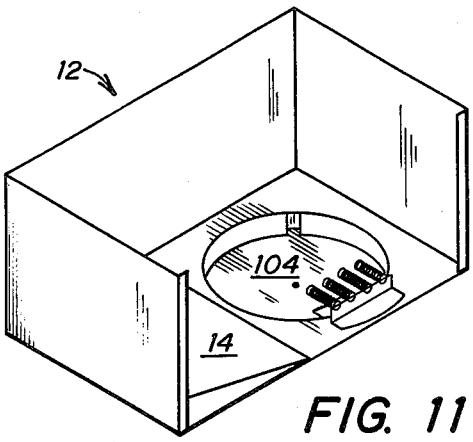
FIG. 11 is a perspective view of a sub-assembly including a reservoir for merchandise to be dispensed.
Figure 9:
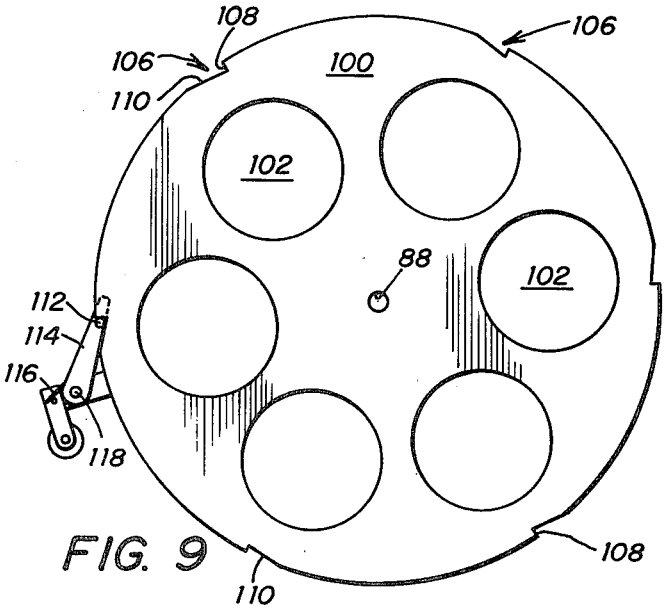
FIG. 9 is a fragmentary, top plan view of the merchandise segregating device which is employed to separate a controlled quantity of merchandise from the rest of the merchandise—upon the deposit of a prescribed coin into a coin slide.
Figure 12:
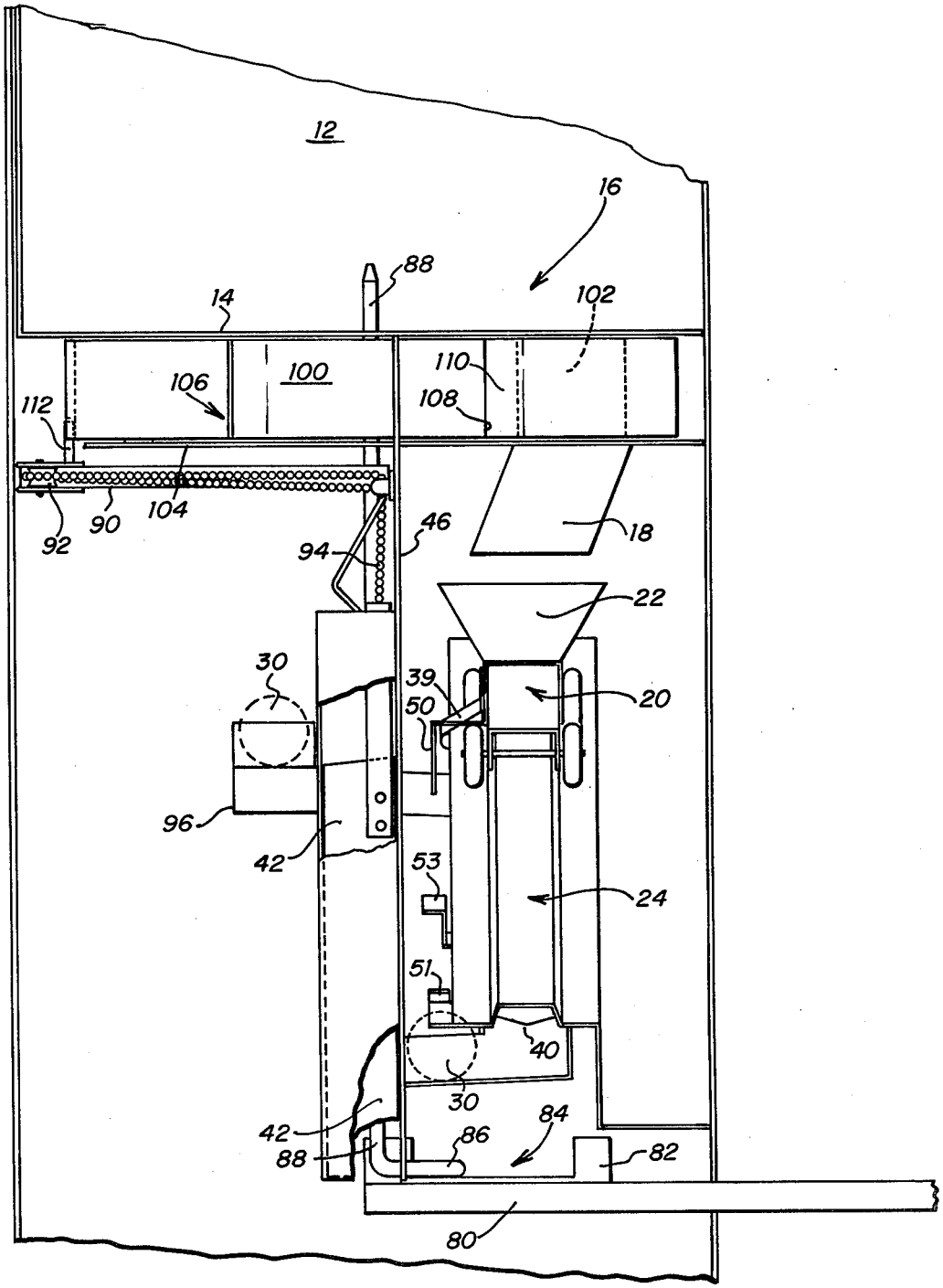
FIG. 12 is a fragmentary side view of the apparatus showing the spatial relationship of many of its parts.

Referring still in FIG. 7 and additionally to FIG. 9, attention will now be directed to the manner in which merchandise is initially removed from the reservoir and deposited into a transportation device. A thick dispensing wheel 100 is positioned in a generally horizontal plane, and it has a central bore which is adapted to fit snugly about crank 88—which is deliberately made extra long in order that its upper end may serve as a journal for the wheel. Extending vertically through the relatively thick wheel 100 are a plurality of bores 102, each of which has a size which is sufficiently large to accommodate merchandise that is to be vended by the apparatus 10. In this particular embodiment wherein the wheel has a diameter of about 6 inches, six bores 102 having a diameter of about 1½ inches are provided. Each of these bores 102 will accommodate a controlled quantity of merchandise (e.g., a single plastic capsule or gumball) and convey it at the proper time to the loading chute 18. The loading chute 18 is rigidly attached to and is supported by a horizontal sheet metal plate 104 which is fixed to the reservoir 12 and lies immediately below the wheel 100; the purpose of plate 104 is to insure that merchandise does not leave one of the bores 102 until it is properly aligned with the chute 18. In a well-known manner, resilient members such as springs extend over the wheel 100 in the region immediately above loading chute 18, so as to prevent more than one cpasule from passing through a particular bore 102 that is temporarily aligned with the loading chute 18. (This construction is shown in FIG. 11.)

The mechanism for causing wheel 100 to rotate within the plane of the wheel includes several parts of the previously described mechanism for causing a ball to temporarily engage a transportation element. This double utilization of hardware obviously contributes to a reduction in the total number of parts, and it also simplifies the mechanism significantly. On the periphery of the wheel 100 there are provided a plurality of notches 106 which have a generally flat, radial face and a slanted "trailing" face which can be said to fair smoothly into circumferential edge of the wheel 100. The radial face 108 has a sufficient depth to receive a driving pin 112 which is carried by pivotable arm 114 and extends upwardly therefrom; arm 114 is mounted on lever arm 90 by pin 118. A small wire spring 116 insures that pin 112 is biased inwardly to what may be called a driving position when arm 90 rotates clockwise. The strength of the spring 116 need not be very great, because it is the relative position of the pin 112 with respect to its support that causes it to remain in driving engagement with the wheel 100 at the time that arm 90 is moving clockwise. That is, the length of pivotable arm 114 and the angle which it forms with respect to arm 90 when the arm is in its "rest" position is such as to cause pin 112 to lie "inside" an imaginary line which extends from pivot point 118 and a respective notch 106. As long as driving pin 112 lies inside that imaginary line, any tangential force exerted by lever arm 90 tends to push pin 112 radially inward against the deepest portion of a notch 106.

During the inward movement of slide 80 and the attendant counter-clockwise movement of crankshaft 88 and lever arm 90, the pivotable arm 114 works against spring 116—and pin 112 rides outward along slanted face 110. Continued counter-clockwise movement of lever arm 90 eventually causes pin 112 to leave a first notch 106 and move across the peripheral face of a static wheel 100 until the pin reaches (and typically passes by a short distance) the next notch. Then, when the lever arm 90 begins its next clockwise movement, spring 116 will bias pivotable arm 114 inward so that pin 112 engages the facing notch 106; continued rotation of lever arm 90 drives the wheel 100 through the required distance to cause a fresh capsule to move into alignment with loading chute 18. Repeated cycling of the slide 80 by a customer causes the process to be repeated, with pin 112 successively moving backward to engage a fresh notch 106 and then driving the wheel 100 forward by another increment—until all of the merchandise in the reservoir 12 has been dispensed. A distinct advantage of having a transparent cover in front of the reservoir 12 is that the customer can clearly see when the reservoir is empty, so that he does not experience the frustration of depositing a coin but receiving no merchandise.

When the reservoir is empty, the owner of the vending device can easily refill the reservoir 12 by tilting the roof of the housing about its horizontal hinge line, whereupon the entire upper portion of the reservoir is accessible. If for some reason there should be any need for inspection of the internal working parts of the apparatus 10, the entire sub-assembly shown in FIG. 11 will lift straight up from the housing, thereby rendering the driving parts of the mechanism in plain sight for examination and/or adjustment. The relatively few moving parts should make any necessary adjustment a simple and quick task. And, after the reservoir 12 is filled with merchandise, the collected coins can be removed through a normally locked door in the bottom of the housing, as is customary with some vending machines.

While only the clearly preferred embodiments of the invention have been disclosed in substantial detail herein, along with a few variations and alternative constructions, it should be readily apparent that still other modifications in the basic design could be realized without departing from the general concepts that hve been disclosed. For example, different merchandise carriers with different hoppers or the like might be substituted for the coal cars and bulldozers; and, depending upon the nature of the hoppers that are utilized, it will be obvious that there may be certain variations in track locations, loading chutes, dumping levers and rest stops, etc. Therefore, the specific embodiments shown herein are not intended to be limiting, and the breadth of the invention should be understood to be measured only by the scope of the attached claims.

What is claimed is:

1. An apparatus for vending a controlled amount of material upon deposit of a prescribed coin, comprising:

(a) a reservoir for containing material which is to be dispensed in controlled quantities;

(b) means for passing a controlled quantity of said material to a loading station in response to the deposit of a prescribed coin;

(c) a movable element having a receptacle for receiving the controlled quantity of material at the loading station;

(d) means for restricting travel of the movable element along a path from the loading station to an unloading station;

(e) a ball having a weight which is relatively great in comparison with the weight of the movable element;

(f) a coin-operated device having a travel path through which a slide moves in response to manual actuation by a customer; and (g) means for causing the ball to temporarily engage the movable element in response to movement of the coin-operated slide, such that the weight of the ball causes the movable element to travel from its loading station to its unloading station, and said means further including an elevator which is associated with the slide of the coin-operated device, such that manual movement of the slide is related to movement of the elevator, and the elevator being shaped to receive and support the ball at appropriate times, and whereby material which is to be vended may be transported by the movable element to the unloading station and delivered to the customer.

2. The vending apparatus as claimed in claim 1 wherein the elevator is mechanically coupled to the slide of the coin-operated device, such that manual movement of the slide causes movement of the elevator and resultant movement of the ball.

3. The vending apparatus as claimed in claim 2 wherein the elevator is allowed to descend upon the inward movement of the coin slide and the elevator is raised by the outward movement of the coin slide, such that the customer who operates the device provides the motive power to dispense the material by virtue of the inward and outward movements of the coin slide.

4. The vending apparatus as claimed in claim 2 wherein the ball is concealed when it is engaged with the movable element, and the elevator is concealed behind an opaque shield, such that the operation of the ball is hidden from view by a customer.

5. The vending apparatus as claimed in claim 1 and further including a counter-weight which is connected to the movable element, and said counter-weight being sufficiently large as to cause the movable element to return to the loading station after it has discharged the material at the unloading station.

6. The vending apparatus as claimed in claim 1 wherein the loading station for the movable element is higher than the unloading station, and the ball has a rest position where it remains between dispensing cycles, and the rest position for the ball is closer to the unloading station than the loading station, whereby the ball remains at rest at a relatively low elevation until it is raised to a higher position during a dispensing cycle.

7. The method of vending merchandise from a machine in response to the deposit of a prescribed coin using a manually activated slide, comprising the steps of:

(a) utilizing the movement of a manually activated slide to move a ball to a position for engaging a merchandise carrier at a loading station for the carrier, and the ball being lifted with an elevator to a position for engaging the merchandise carrier in response to moving the coin slide within the machine;

(b) utilizing the weight of the ball to operate on the loaded merchandise carrier so as to move said carrier from the loading station to an unloading station;

(c) disengaging the ball from an operative association with the merchandise carrier at the unloading station after the merchandise has been removed from the carrier; and (d) returning the merchandise carrier to the loading station to await the deposit of another coin and the loading of new merchandise.

8. The method of vending merchandise as claimed in claim 7 wherein the merchandise carrier is returned to the loading station by continuously biasing it toward the loading station with a counter-weight that is heavier than the carrier but lighter than the ball.

9. The method of vending merchandise as claimed in claim 7 and including the further step of segregating a controlled quantity of merchandise from a reservoir of merchandise which is to be vended, and wherein said segregating is accomplished by utilizing a common rotative apparatus which causes the ball to engage the merchandise carrier and moves a controlled quantity of merchandise to the loading station.

10. The method of vending merchandise as claimed in claim 7 wherein the ball is lifted to a position for engaging the merchandise carrier by lifting said ball with an elevator, and the elevator is lifted by a chain which is connected to the slide, and wherein the chain is pulled by manually inserting a coin into the machine using said slide.

11. An apparatus for vending a controlled amount of material upon deposit of a prescribed coin, comprising:

(a) a reservoir for containing material which is to be dispensed in controlled quantities;

(b) a coin-operated device having a travel path through which a coin slide moves in response to manual actuation by a customer;

(c) means for passing a controlled quantity of the material to be vended from the reservoir to a loading station in response to certain movement of the coin slide;

(d) a carrier having a receptacle for receiving the controlled quantity of material at the loading station, and the carrier being continuously biased to the loading station by a counter-weight;

(e) track means for restricting travel of the carrier to a path between the loading station and an unloading station;

(f) a ball having a weight which is relatively great in comparison with the weight of the carrier and the counter-weight;

(g) an elevator for lifting the ball to a position near the loading station, and the elevator being connected to the coin slide so as to be movable by virtue of coin slide movement; and (h) means for causing the ball to temporarily engage the carrier after the ball has been lifted by the elevator, and causing the carrier to travel from its loading station to its unloading station, whereby material which is to be vended may be transported by the carrier and delivered to the customer.

12. The vending apparatus as claimed in claim 11 wherein the ball weighs about 37 grams and it is lifted about 5 inches by the elevator, whereby a substantial amount of potential energy is imparted to the ball for subsequently pushing the carrier to the unloading station against the force of the counter-weight.

13. The vending apparatus as claimed in claim 11 wherein said means for passing a controlled quantity of material from the reservoir to a loading station is connected to the coin slide so as to be operable by movement of the coin slide, such that those portions of the apparatus which require the input of energy are all connected to the coin slide, whereby operation of the apparatus may be exclusively accomplished by manual movement of the coin slide by a customer, and whereby the necessity for an auxiliary power source is obviated.

14. The vending apparatus as claimed in claim 11 wherein the elevator constitutes an elongated block which rides internally of a tube, and the tube having a lower opening for accepting a ball and an upper opening for discharging the ball, and the elongated block having a length which is greater than the distance between the two openings, whereby the lower portion of the elongated block prevents a second ball from entering the tube while a first ball is being raised to the discharge opening.

15. The vending apparatus as claimed in claim 11 wherein the normal rest position for the elevator is its uppermost position, and the elevator descends to pick up a waiting ball when the coin slide is manually actuated by a customer.

16. The vending apparatus as claimed in claim 11 wherein the connection between the elevator and the coin slide includes a crank and a flexible chain which passes over at least one pulley such that movement of the coin slide in a horizontal plane is converted into movement of the elevator in a remote and generally vertical plane without the need for any sensitive adjustments in alignment.

17. The vending apparatus as claimed in claim 11 wherein the reservoir constitutes a metal structure having a floor and rear and side walls attached to the floor, and the metal structure is readily removable as a unit from an open-top housing which supports the remainder of the vending apparatus, whereby the reservoir and its contents may be easily separated from the remainder of the apparatus for cleaning or maintenance.

18. The vending apparatus as claimed in claim 11 and further including a second ball which is substantially the same size and weight as the first ball, and the two balls being serially arranged so as to alternately engage the carrier at its loading station, whereby one of the balls may be at rest at the end of an excursion path while the other ball is in movement as a result of actuation of the coin-operated device by a customer, and whereby it is essentially impossible for a customer to sequentially insert coins so fast that there will not be a ball which is in a rest position where it is available to respond to the insertion of a given coin.

* * * * *